US005528895A

United States Patent [19]

Deno

[11] Patent Number: 5,528,895

[45] Date of Patent: Jun. 25, 1996

[54] SPINNING APPARATUS WITH TWISTING GUIDE SURFACE

[75] Inventor: Koji Deno, Oumihachiman, Japan

[73] Assignee: Murata Kikai Kabushiki Kaisha, Kyoto, Japan

[21] Appl. No.: 300,812

[22] Filed: Sep. 2, 1994

[30] Foreign Application Priority Data

Sep. 8, 1993 [JP] Japan ..... 5-247508

[51] Int. Cl.[6] ..... D01H 5/00; D01H 5/28

[52] U.S. Cl. ..... 57/328; 57/315; 57/333; 57/350; 57/352

[58] Field of Search ..... 57/332, 328, 341, 57/342, 343, 344, 350, 333, 315, 5, 352

[56] References Cited

U.S. PATENT DOCUMENTS

| | | | |
|---|---|---|---|
| 3,722,198 | 3/1973 | Gotzfried | 57/333 |
| 4,444,003 | 4/1984 | Gotzfried | 57/5 |
| 5,146,740 | 9/1992 | Mori | 57/5 |
| 5,159,806 | 11/1992 | Mori et al. | 57/5 |
| 5,193,335 | 3/1993 | Mori | 57/328 |
| 5,211,001 | 5/1993 | Mori | 57/328 |
| 5,263,310 | 11/1993 | Mori | 57/5 |
| 5,398,493 | 3/1995 | Onishi et al. | 57/328 |

FOREIGN PATENT DOCUMENTS

| | | | |
|---|---|---|---|
| 3193922 | 8/1991 | Japan | 57/328 |
| 4-163325 | 6/1992 | Japan | 57/328 |

*Primary Examiner*—William Stryjewski
*Attorney, Agent, or Firm*—Loeb & Loeb

[57] ABSTRACT

A spinning apparatus for producing a spun yarn by using swirling air currents to twist a non-twisted short staple fiber bundle drafted by a drafting unit. A nozzle block having at least one nozzle provides a swirling air current that acts upon the fiber bundle. A fiber bundle passage is defined by the nozzle block and a needle holder having a substantially central, longitudinal axis and a guide surface that twists relative to the longitudinal axis. A guide member associated with the needle holder projects toward the inlet of a hollow spindle.

11 Claims, 6 Drawing Sheets

SPINNING APPARATUS WITH TWISTING GUIDE SURFACE

BACKGROUND OF THE INVENTION

1. Field of the Invention

The present invention relates to a spinning apparatus, and in particular a spinning apparatus for producing a spun yarn by using swirling air currents to twist a non-twisted short staple fiber bundle drafted by a drafting unit.

2. Description of Related Art

A known spinning apparatus comprises a nozzle block provided with nozzles for jetting air to induce swirling air currents that act on a fiber bundle delivered from a drafting unit. Such known spinning apparatus includes a hollow spindle and a guide member disposed with its extremity located near the inlet end of the hollow spindle, and capable of twisting the non-twisted fiber bundle by the agency of the swirling air currents to produce a spun yarn.

One example of such a known spinning apparatus is shown in FIG. 5. As shown in FIG. 5, a needle holder 4' which holds a guide member 5 may be placed at the inlet of a nozzle block 2. The needle holder 4' may be formed by cutting a portion of a cylindrical body provided with a projection at one end thereof along a plane parallel to and spaced from the axis of the cylindrical body. A fiber bundle F delivered from a drafting unit advances into the nozzle block 2 through a fiber bundle inlet 13 defined by the inner circumference of the nozzle block 2 and the flat guide surface of the needle holder 4'.

In this known spinning apparatus, vortices are generated in the swirling air currents swirling around the guide member 5, as indicated by the clockwise directed arrow in the lower portion of FIG. 5. These vortices urge some of the component fibers of the fiber bundle F toward the "wrong" side of the guide member 5. Consequently, the arrangement of the binding fibers is disturbed, which in turn may reduce the strength of the resultant spun yarn.

It is an object of the present invention to provide a spinning apparatus for twisting a fiber bundle moving around a guide member with swirling air currents that is capable of reducing or eliminating the swirling vortices that would otherwise dishevel the fiber bundle and that is consequently capable of producing a spun yarn having a relatively higher strength.

SUMMARY OF THE INVENTION

In accordance with the present invention, these and other objectives are achieved by providing a spinning apparatus that uses a swirling air current to twist a short, non-twisted staple fiber bundle drafted by a drafting device to produce a spun yarn. In its preferred embodiment the spinning apparatus comprises a number of elements in combination, including a nozzle block having nozzles for providing swirling air currents that act on a fiber bundle delivered from a drafting unit, a needle holder having a twisting guide surface that gently twists around the longitudinal axis of the needle holder and that defines a fiber bundle passage, a rotary or stationary hollow spindle, and a guide member associated with the needle holder and projecting toward the inlet of the hollow spindle.

In its preferred embodiment, the fiber bundle passage has a cross sectional area which gradually decreases at a substantially fixed rate toward the front of the passage. The guide surface of the needle holder defining the fiber bundle passage is twisted and has a substantially smooth shape without step-like transitions. Consequently, the swirling air currents are substantially undisturbed and virtually no vortices are generated in the swirling air currents. Hence, a fiber bundle delivered from a drafting unit and drawn into the spinning apparatus by currents of air blown through nozzles is caused to turn smoothly by the swirling air currents without being disheveled. The leading ends of substantially all of the component fibers of the fiber bundle advance around the guide member and are drawn into the hollow spindle by the fibers of the preceding portion of the fiber bundle being twisted into a spun yarn. The trailing ends of the fibers are inverted at the inlet of the hollow spindle, separated from each other, and exposed to the swirling currents of air blown through the nozzles. The trailing ends of the fibers are thereby caused to twist around the portion of the fiber bundle being converted into a spun yarn to form a spun yarn like an actually twisted spun yarn.

A spun yarn produced by a spinning apparatus in accordance with the present invention generally has a relatively large number of binding fibers. Such a spun yarn compares favorably with a spun yarn produced by a ring spinning frame with respect to both appearance and strength. A spun yarn produced by a spinning apparatus in accordance with the present invention tends to have a more uniform appearance, less unevenness, a higher strength and more twists than a spun yarn produced by known spinning apparatus.

BRIEF DESCRIPTION OF THE DRAWINGS

A detailed description of a preferred embodiment of the present invention will be made with reference to the accompanying drawings, wherein like numerals designate corresponding parts in the several figures.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
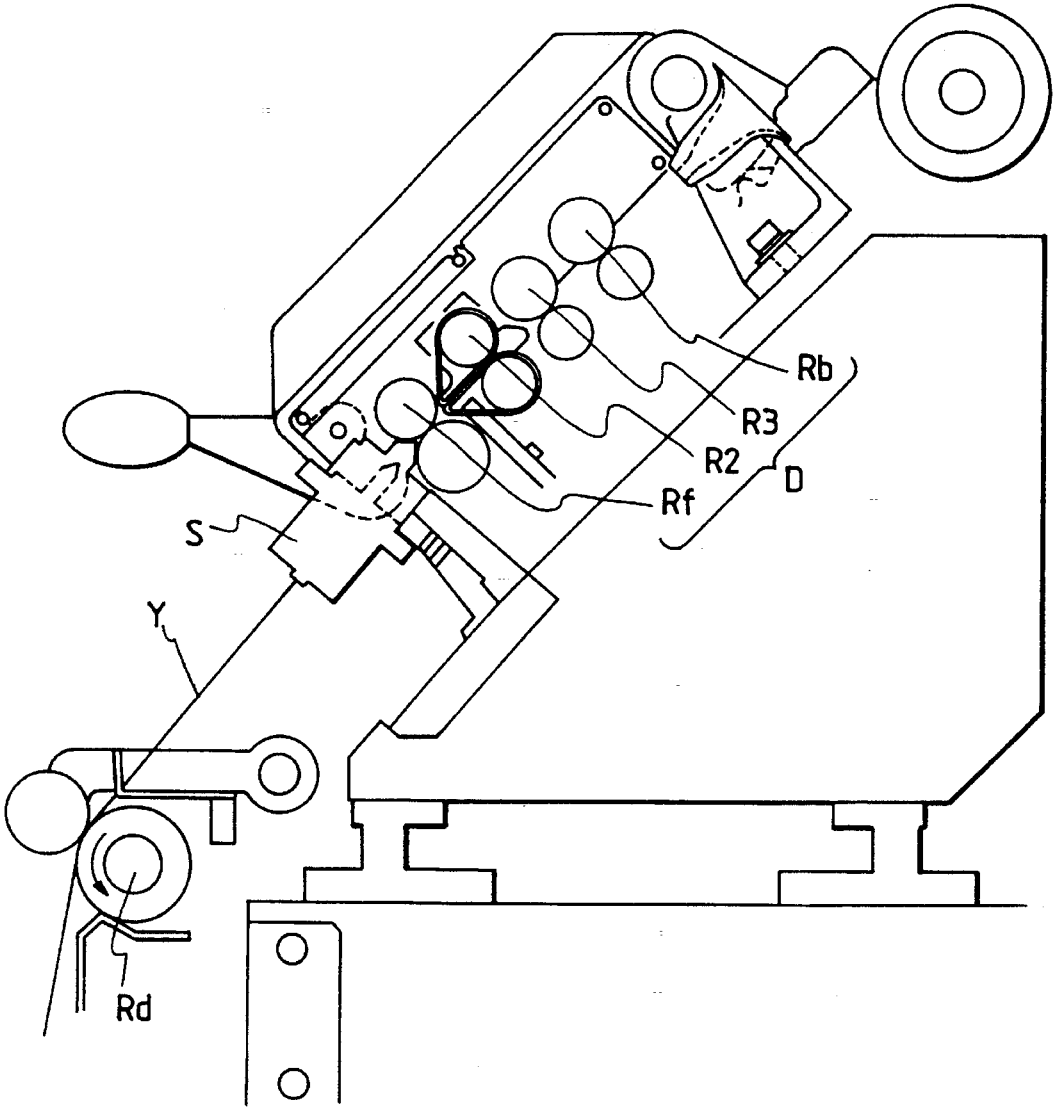
FIG. 1 shows a side view illustrating an example of a drafting unit, a delivery roller, and a spinning apparatus in accordance with a preferred embodiment of the present invention.

FIG. 1 illustrates an example of a drafting device D comprising a front or first roller Rf, a second roller R2 provided with a control apron, a third roller R3 and a back roller Rb. A preferred embodiment of a spinning device S in accordance with the present invention may be disposed between the front roller Rf of the drafting device D and a delivery roller Rd.

Figure 2:
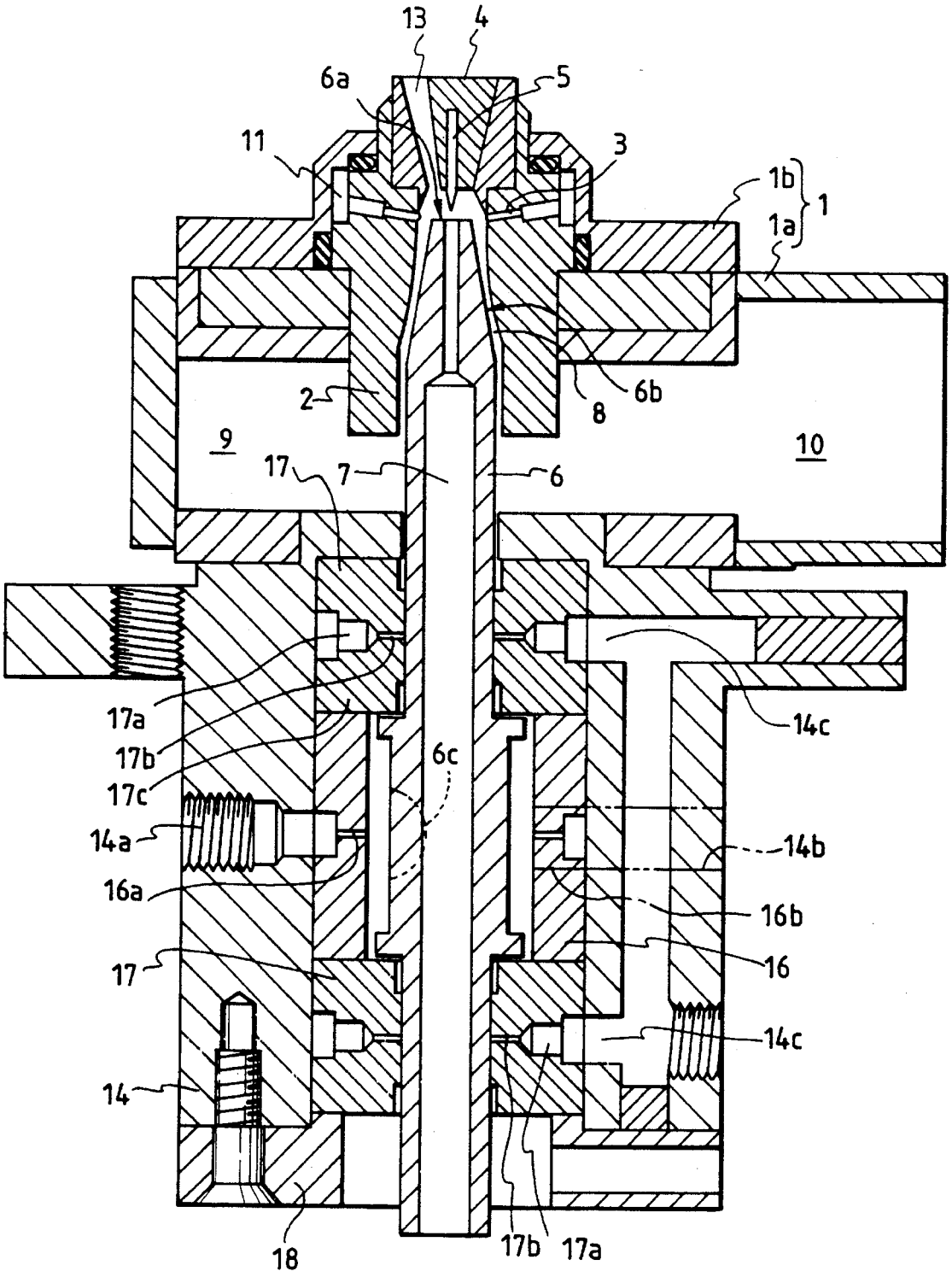
FIG. 2 shows a longitudinal sectional view of an example of a spinning apparatus in accordance with a preferred embodiment of the present invention.
Figure 3B:
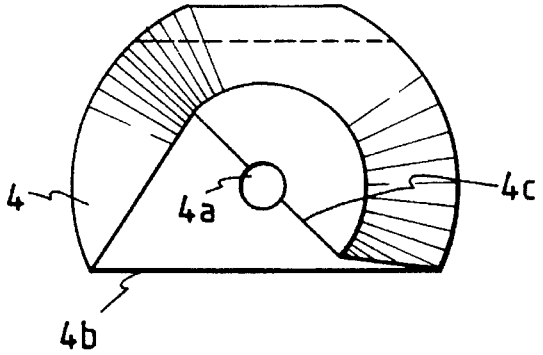
FIGS. 3(*a*), 3(*b*), 3(*c*) and 3(*d*) show a perspective view, a plan view, a front view and a side view, respectively, of an example of a needle holder that may be included in a spinning apparatus in accordance with a preferred embodiment of the present invention.
Figure 3A:
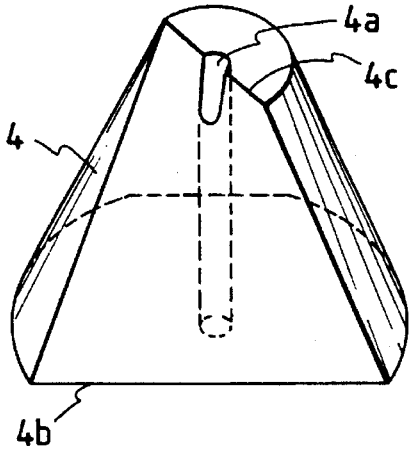
Figure 3D:
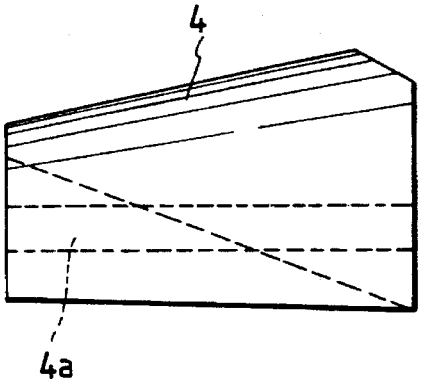
Figure 3C:
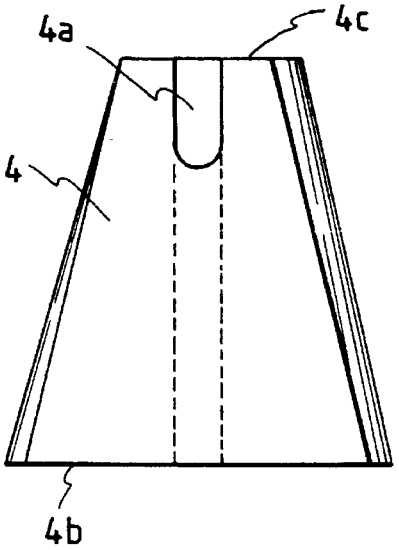

Referring to FIG. 2, a preferred embodiment of a spinning device S in accordance with the present invention may comprise a nozzle block 2 disposed within a casing 1 located below the drafting device D. In the embodiment illustrated in FIG. 2, the casing 1 comprises a lower casing 1*a* and an upper casing 1*b*. The nozzle block 2 is provided with nozzles 3. A needle holder 4 is disposed at the inlet end of the nozzle block 2. The needle holder 4 holds a guide member 5. A rotary spindle 6 having an inlet extends into the casing 1.

In the embodiment illustrated in FIG. 2, the spindle 6 defines a substantially coaxial fiber bundle passage 7. The inlet end 6*a* of the spindle 6 has a relatively small diameter. The spindle 6 is preferably tapered toward the inlet end 6*a* to form a conical portion 6*b*.

Still referring to FIG. 2, the illustrated preferred embodiment includes a substantially cylindrical cavity 8 having a relatively small diameter formed in a portion of the nozzle block 2 that surrounds the tapered portion of the spindle 6, including the inlet end 6*a*. The diameter of the back end of the cavity 8 is slightly greater than that of the back end of the spindle 6. An annular chamber 9 formed in the lower casing la communicates with both the cavity 8 and a tangential air outlet 10.

In the embodiment illustrated in FIG. 2, a substantially annular air accumulating chamber 11 is formed between the nozzle block 2 and the upper casing 1*b*. The nozzle block 2 is provided with four nozzles 3 that are tangential to the cavity 8. The nozzles 3 are slightly inclined in the direction of movement of the fiber bundle and open into the cavity 8 at positions that are slightly spaced from the inlet end 6*a* of the spindle 6. A pipe (not shown) is connected to an inlet port (not shown) that communicates with the air accumulating chamber 11. The nozzles 3 are directed in the rotating direction of the spindle 6.

In the illustrated embodiment, compressed air is supplied through the pipe into the air accumulating chamber 11. The compressed air is jetted into the cavity 8 to produce rapid swirling air currents in the vicinity of the inlet 6*a* of the spindle 6. The swirling air currents produced within the cavity 8 whirl in the annular chamber 9 and flow outside through the air outlet 10. The swirling air currents produce suction air currents that flow from the vicinity of the front roller Rf into the casing 1.

Referring to FIG. 3, the illustrated preferred embodiment of the needle holder 4 has a shape substantially resembling a truncated circular cone. The needle holder 4 has a twisted guide surface that gently twists around the longitudinal axis of the needle holder 4 in the swirling direction of the swirling air currents. The needle holder 4 is provided with a center hole 4*a* in the front end thereof. A pin-like guide member 5 is fixedly disposed in the center hole 4*a*.

In the embodiment illustrated in FIG. 3, the back edge of the twisting guide surface at the back end of the needle holder 4 is indicated at 4*b*. The front edge of the twisting guide surface at the front end of the needle holder 4 is indicated at 4*c*. The front edge 4*c* intersects the central axis of the needle holder 4. The back edge 4*b* is spaced from the central axis of the needle holder 4. The angle of twist between the back edge 4*b* and the front edge is preferably in the range of from 30° to 45°. Spinning is possible with the angle of twist being in the range of from 20° to 100°, but 30° to 40° is preferable. A greater twist angle is generally desirable for spinning a spun yarn having a greater yarn count.

As shown in FIG. 2, in the illustrated embodiment the needle holder 4 is plugged into a tapered hole formed in the back end of the nozzle block 2. The extremity of the guide member 5 that projects from the center of the front end of the needle holder 4 is located close to the inlet end 6*a* of the spindle 6. A twisting fiber bundle passage 13 is formed between the twisting guide surface of the needle holder 4 and the inner circumference of the nozzle block 2.

Still referring to FIGS. 2 and 3, the illustrated needle holder 4 has a relatively smooth shape without any step-like transitions. The illustrated twisting fiber bundle passage 13 is relatively longer than that defined by the flat fiber bundle guide surface of a known needle holder. (Compare, for example, the needle holder shown in FIG. 4 and the prior art structure shown in FIG. 5). The cross sectional area of the needle holder 4 decreases at a substantially fixed rate toward the front. Accordingly, virtually no vortices are produced in the swirling currents of air that are generated via the nozzles 3. Consequently, the fiber bundle F advances smoothly together with the swirling air currents without being disheveled, and the component fibers of the fiber bundle F are gathered gradually as the fiber bundle advances (as shown, for example, in FIG. 4). Accordingly, spun yarn produced by a spinning device in accordance with the present invention, as compared with spun yarn produced by a known spinning device, is generally more uniform in appearance and thickness and has less unevenness (IPI) and more strength. The number of twists inserted in a spun yarn produced by a spinning device in accordance with the present invention is generally greater than the number of twists inserted in a spun yarn produced by a known spinning device.

The following is a description of an example of a device which may be used for driving the spindle 6.

Again referring to the preferred embodiment illustrated in FIG. 2, the spindle driving device is supported in a pneumatic bearing having a bearing casing 14. The bearing casing 14 defines air inlet ports 14*c*. The pneumatic bearing is also provided with cylindrical bushings 17. The cylindrical bushings 17 define air chambers 17*a* and jet nozzles 17*b*. Compressed air is supplied via the air inlet ports 14*c* and flows through the air chambers 17*a*, the jet nozzles 17*b*, and the small clearance between the spindle 6 and the bushings 17.

In the illustrated preferred embodiment, a cylindrical bushing 16 is disposed in the bearing casing 14. The bushing 16 is provided with a compressed air jetting hole 16*a* that is tangent to the inner circumference of the bushing 16, and an air discharge hole 16*b*. The bearing casing 14 is provided with a compressed air inlet port 14*a* that communicates with the compressed air jetting hole 16*a*, and an air discharge port 14*b* that communicates with the air discharge hole 16*b*.

Figure 6:
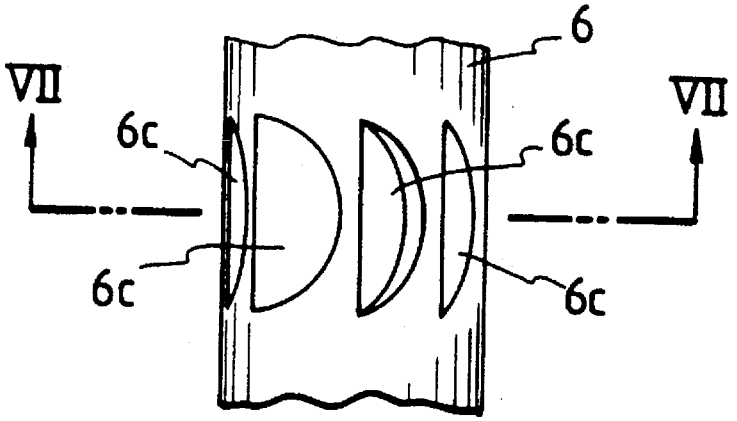
FIG. 6 shows a side view of an example of a spindle for use in a spinning apparatus in accordance with a preferred embodiment of the present invention.
Figure 7:
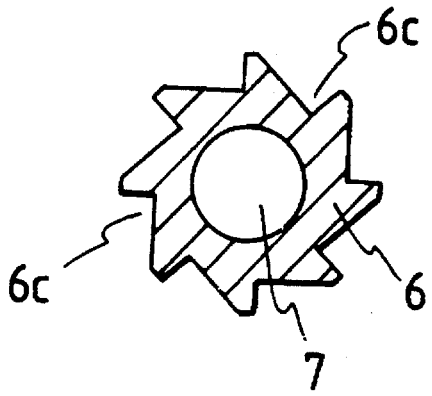
FIG. 7 shows an end view of the spindle illustrated in FIG. 6.
Figure 8:
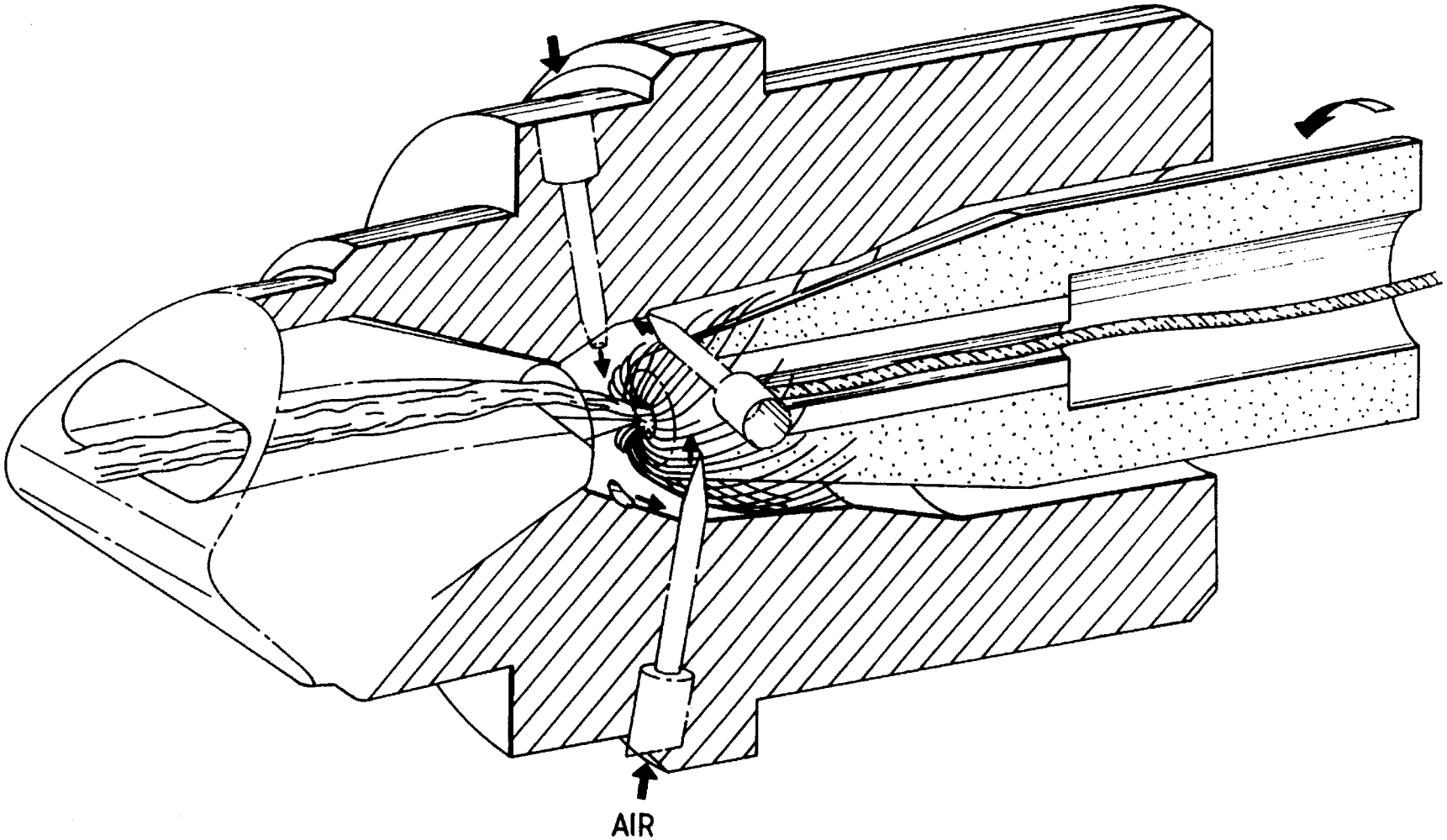
FIG. 8 shows a perspective view of an example of a spinning apparatus in accordance with a preferred embodiment of the present invention.

Referring now to FIGS. 2, 6 and 7, the illustrated spindle 6 is provided with at least one substantially semicircular recess 6*c* in a portion of the outer circumferential surface of the spindle 6 generally corresponding in position to the compressed air jetting hole 16*a*. In the embodiment illustrated in FIGS. 6 and 7 a plurality of recesses 6*c* are shown. In the illustrated embodiment the substantially semicircular recesses 6c do not extend through the wall of the spindle 6, but instead merely establish a series of substantially spherical or semispherical depressions in the exterior wall of the spindle.

In operation, compressed air supplied via the inlet port 14a is jetted through the compressed air jetting hole 16a against the recesses 6c of the spindle 6 to thereby rotate the spindle 6. As a result primarily of frictional contact between the fibers within the spindle and the inner wall of the spindle, the fibers within the spindle are caused to rotate by the rotation of the spindle. The compressed air is discharged through the air discharge hole 16b and the air discharge port 14b.

The spindle 6 may be rotated for assistance in twisting the fiber bundle. However, the spindle 6 need not necessarily be rotated, and some types of yarn do not require the rotation of the spindle 6.

Figure 4:
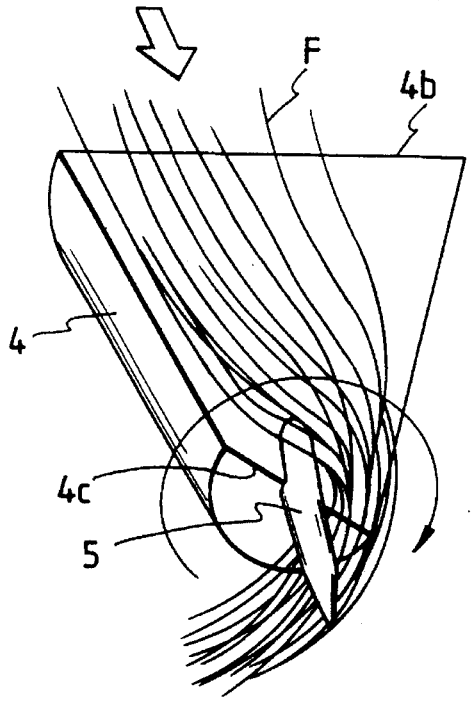
FIG. 4 shows a perspective view that is of assistance in explaining a mode of movement of a fiber bundle in the vicinity of an inlet of a spinning apparatus in accordance with a preferred embodiment of the present invention.
Figure 5:
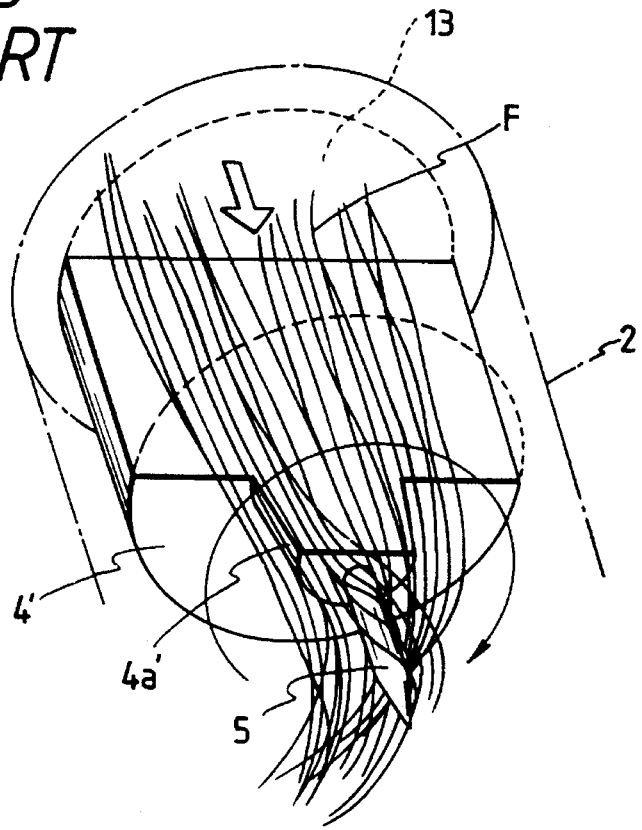
FIG. 5 PRIOR ART
FIG. 5 shows a perspective view of an inlet of a known spinning apparatus.

Referring again to the preferred embodiment illustrated in FIGS. 1, 2 and 4, the spinning device draws therein the fiber bundle F delivered from the drafting device D by the agency of the air currents jetted through the nozzles 3. Since the sectional area of the fiber bundle guide passage 13 decreases toward the front at a substantially fixed rate and the fiber bundle guide passage 13 is twisted, virtually no vortices are produced in the swirling air currents. Consequently, the fiber bundle F is not disheveled and moves smoothly together with the swirling air currents. The leading ends of virtually all the component fibers of the fiber bundle F are drawn around the guide member 5 into the rotating spindle 6 by the preceding portion of the fiber bundle F being converted into a spun yarn. The trailing portions of the component fibers of the fiber bundle F are inverted at the inlet end of the spindle 6 and are separated from each other by the axial component of the currents of air jetted through the nozzles 3. Then, the separated trailing end portions of the fibers are twisted around the portion of the fiber bundle F being converted into a spun yarn by the swirling currents of air jetted through the nozzles 3. Thus, a spun yarn consisting of core fibers and spiral fibers binding the core fibers like an actually twisted spun yarn can be produced.

Since spun yarn produced by a spinning device in accordance with the present invention generally has a relatively large number of binding fibers, the strength and appearance of the spun yarn compares favorably with spun yarn produced by a ring spinning frame. Since the needle holder has a generally smooth shape without step-like transitions and defines a comparatively longer fiber bundle passage having a sectional area decreasing toward the front at a substantially fixed rate, the production of vortices in the swirling air current is essentially eliminated, the fiber bundle is not disheveled, and the fiber bundle is able to move smoothly together with the swirling air in the spinning device. Consequently, spun yarn produced by a spinning device in accordance with the present invention has a more uniform, less uneven appearance, a higher strength and more twists than that produced by an equivalent known spinning device.

The table below provides a comparison of spinning yarn data between a prior art yarn in which there is no twist and an example of a yarn made in accordance with the present invention:

| | PRIOR ART | INVENTION |
|---|---|---|
| YARN CHARACTERISTICS | NO TWIST | 45° TWIST |

-continued

| | PRIOR ART | INVENTION |
|---|---|---|
| STRENGTH (gr/Tex) | 10.97 | 12.93 |
| NUMBER OF TWISTS IN YARN (T/M) | 884 | 998 |
| NEP (+200%/Km) | 1000 | 855 |

In the example provided in the above table, the spinning conditions were as follows: Spinning yarn count: Ne 40; Nozzle pressure: 3 Kgf/cm$^2$; Spinning speed 250 m/min.

The presently disclosed embodiments are to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A spinning apparatus comprising:

a nozzle block provided with nozzles for jetting air to induce swirling air currents that act on a staple fiber bundle delivered from a drafting unit, a needle holder having a substantially central, longitudinal guide axis, a back edge, a front edge, and a substantially smooth guide surface extending between the back edge and the front edge, the front edge and the back edge each being substantially perpendicular to the guide axis and the front edge being turned relative to the back edge by an angle of less than 360° and greater than 0°, the guide surface twisting relative to the guide axis of the needle holder and defining a fiber bundle passage, a rotary or stationary hollow spindle having an inlet end, and a guide member held on the needle holder so as to extend toward the inlet end of the hollow spindle.

2. A spinning apparatus comprising:

a nozzle block having at least one nozzle for providing a swirling air current that acts upon a fiber bundle, a needle holder having a substantially central, longitudinal axis, a back edge, a front edge, and a substantially smooth guide surface extending between the back edge and the front edge, the front edge and the back edge each being substantially perpendicular to the guide axis and the front edge being turned relative to the back edge by an angle of less than 360° and greater than 0°, the guide surface twisting relative to the longitudinal axis of the needle holder, the nozzle block and the needle holder defining a fiber bundle passage, a hollow spindle defining a longitudinal axis and having an inlet, and a guide member associated with the needle holder and projecting toward the inlet of the hollow spindle.

3. The device of claim 2, wherein the needle holder has a substantially conical shape.

4. The device of claim 2, wherein the swirling air current defines a swirling direction and wherein the guide surface of the needle holder twists relative to the longitudinal axis of the needle holder in a direction corresponding to the swirling direction.

5. The device of claim 2, wherein the back edge is spaced from the central longitudinal axis of the needle holder and the front edge substantially intersects the central longitudinal axis of the needle holder.

6. The device of claim 5, wherein the guide surface of the needle holder defines a twisting angle between the back edge and the front edge that is in the range of from 30° to 45°.

7. The device of claim 2, wherein the needle holder defines a front end having a center and wherein the guide member is disposed at the center of the front end of the needle holder.

8. The device of claim 2, wherein the hollow spindle defines a substantially fixed position.

9. The device of claim 2, wherein the hollow spindle is rotatable about its longitudinal axis.

10. The device of claim 9, comprising means for rotating the hollow spindle about its longitudinal axis.

11. The device of claim 2, wherein the fiber bundle passage defines a downstream end and a cross sectional area which gradually decreases at a substantially fixed rate toward the downstream end of the passage.

* * * * *